US005890529A

United States Patent [19]

Haarer

[11] Patent Number: 5,890,529

[45] Date of Patent: Apr. 6, 1999

[54] DUAL ACTION RETRACTABLE CORD TAKE-UP REEL

[75] Inventor: Steven Ray Haarer, Sturgis, Mich.

[73] Assignee: Kirsch Inc., Sturgis, Mich.

[21] Appl. No.: 790,557

[22] Filed: Jan. 29, 1997

[51] Int. Cl.[6] ..... A47G 5/02

[52] U.S. Cl. ..... 160/319; 192/46; 192/48.92; 192/93 A

[58] Field of Search ..... 160/319, 321, 160/910, 309; 242/375.3, 385.2, 385.1, 394, 394.1; 192/48.92, 46, 93 A

[56] References Cited

U.S. PATENT DOCUMENTS

| | | | |
|---|---|---|---|
| 2,195,859 | 4/1940 | Gent | 242/394.1 X |
| 2,864,923 | 12/1958 | Mathews . | |
| 3,092,174 | 6/1963 | Winn | 160/319 X |
| 3,275,780 | 9/1966 | Baba | 242/385.1 X |
| 3,306,406 | 2/1967 | Poliseo . | |
| 3,623,582 | 11/1971 | Giger et al. . | |
| 4,139,044 | 2/1979 | Brolin | 160/321 |
| 4,352,710 | 10/1982 | Makley . | |
| 4,466,475 | 8/1984 | Saito et al. . | |
| 4,519,487 | 5/1985 | Florin . | |
| 4,865,109 | 9/1989 | Sherman | 160/321 |
| 5,031,682 | 7/1991 | Tedeschi . | |

FOREIGN PATENT DOCUMENTS 0 356 403A1 2/1990 European Pat. Off. .

*Primary Examiner*—Blair M. Johnson

*Attorney, Agent, or Firm*—Foley & Lardner

[57] ABSTRACT

A retractable cord take-up reel comprises a drive shaft and a first reel mounted on the drive shaft. The first reel has a central opening and a first side. A drive shaft gear is mounted on the drive shaft, and rotating the drive shaft gear causes the drive shaft to rotate. A first drive gear is mounted on the drive shaft between the first reel and the first drive shaft gear. The first drive gear has a central opening and a first side facing the first reel and a second side facing the drive shaft gear. One of the first side of the first reel and the first side of the first drive gear has an angled surface, and the other of the first side of the first reel and the first side of the first drive gear has a cog facing the one first side. The one first side has two steps for engaging the cog. A first one of the steps is at a low location on the angled surface, and a second one of the steps is at a high location on the angled surface. When the cog is engaged with the first step, the first drive gear is engaged with the drive shaft gear. When the cog is engaged with the second step, the first drive gear is not engaged with the drive shaft gear. A cord is wound on the first reel. When the cord is pulled, the first reel rotates so that the cog engages with the first step, and the drive shaft is driven in a first direction. The retractable cord take-up reel further comprises a second reel and a second drive gear. The second reel and the second drive gear are configured similar to the first reel and the first drive gear and are mounted on the drive shaft on an opposite side from the first reel and the first drive gear. A cord is wound on the second reel so that when the cord on the second reel is pulled, the drive shaft is driven in a second direction that is opposite the first direction.

20 Claims, 2 Drawing Sheets

FIG. 2
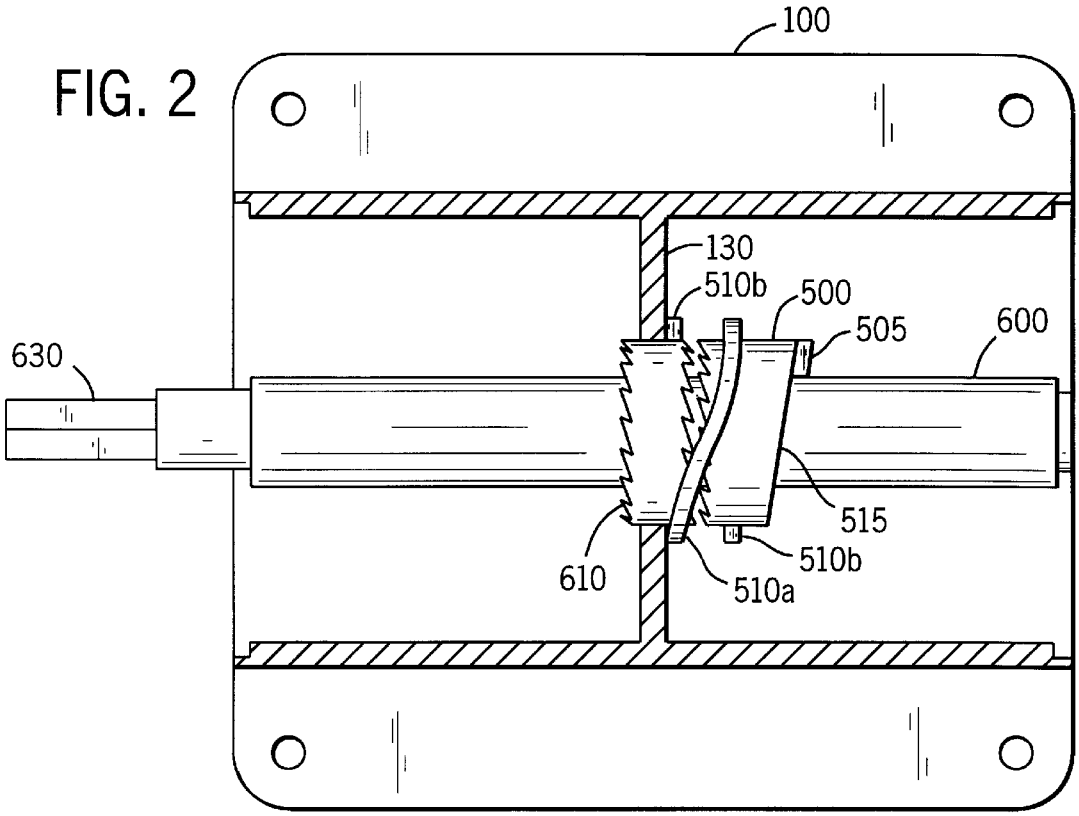
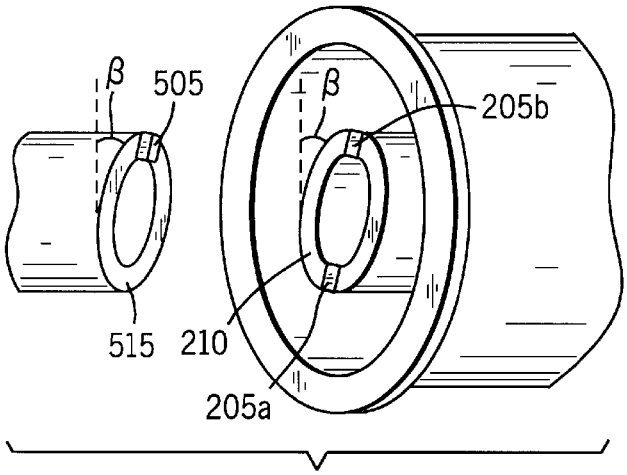
FIG. 3

DUAL ACTION RETRACTABLE CORD TAKE-UP REEL

BACKGROUND

1. Field of the Invention

The present invention relates to a retractable take-up reel. More particularly, the present invention relates to a dual action retractable cord take-up reel for adjusting a position of a window covering.

2. Description of Related Art

Conventional window covering designs employ cord loops for adjusting a position of the window covering, e.g., for raising and lowering the window covering. A cord loop is typically wound around a cord drive wheel, which is connected to a drive shaft. The drive shaft is connected to the window covering. Pulling on one side of the cord loop causes the cord drive wheel to rotate in a first direction, which in turn causes the drive shaft to rotate in the first direction. The rotation of the drive shaft in the first direction causes the window covering to move in the first direction, thus, for example, raising the window covering. Pulling on the other side of the cord loop causes the cord take-up wheel to rotate in a second direction, opposite from the first direction, which in turn causes the drive shaft to rotate in the second direction. The rotation of the drive shaft in the second direction causes the window covering to move in the second direction, thus, for example, lowering the window covering. In this manner, the window covering is raised or lowered by pulling on opposite sides of the cord loop.

Attempts have been made to eliminate cord loops, which can get caught on objects. For example, motorized window coverings have been introduced which eliminate cord loops. Such motorized window coverings are complex and expensive.

Another attempt employs multiple cords with individual tassels. For example, a tassel has been developed which provides a breakaway method of holding multiple cords together until a predetermined weight causes them to separate. According to this technique, the ends of two cords are each connected to cylindrical pieces that snap together to form one continuous cylindrical piece, forming a "loop" between the two cords. If the loop gets caught on an object, the weight of the object causes the cylindrical pieces to unsnap. A problem with this technique is that the cylindrical pieces add to the overall size, cost, and complexity of the window covering and are unsightly.

There is thus a need for a system that adjusts a position of a window covering without a cord loop simply, unobtrusively, and at low cost.

OBJECTS AND SUMMARY

It is an object of the present invention to provide a simple, inexpensive, and unobtrusive apparatus for adjusting a position of a window covering without a cord loop.

According to one embodiment of the present invention, this objective is met by a retractable cord take-up reel. The take-up reel comprises a drive shaft and a first reel mounted on the drive shaft. The first reel has a central opening and a first side. A drive shaft gear is mounted on the drive shaft, and the drive shaft is rotated by rotation of the drive shaft gear. A first drive gear is mounted on the drive shaft between the first reel and the drive shaft gear. The first drive gear has a central opening and a first side facing the first reel and a second side facing the drive shaft gear. One of the first side of the first reel and the first side of the first drive gear has an angled surface, and the other of the first side of the first reel and the first side of the first drive gear has a cog facing the one first side. The one first side has two steps for engaging the cog. A first one of the steps is at a low location on the angled surface, and a second one of the steps is at a high location on the angled surface. When the cog is engaged with the first step, the first drive gear is engaged with the drive shaft gear. When the cog is engaged with the second step, the first drive gear is not engaged with the drive shaft gear. A cord is wound on the first reel, and when the cord is pulled, the first reel rotates so that the cog engages with the first step, and the drive shaft is driven in a first direction.

According to one embodiment of the present invention, the retractable cord take-up reel further comprises a second reel and a second drive gear. The second reel and the second drive gear are configured similar to the first reel and the first drive gear and are mounted on the drive shaft on an opposite side from the first reel and the first drive gear. A cord is wound on the second reel so that when the cord on the second reel is pulled, the drive shaft is driven in a second direction that is opposite the first direction.

BRIEF DESCRIPTION OF THE DRAWINGS

The objects and advantages of the invention will be understood by reading the following detailed description in conjunction with the drawings in which:

FIG. 2 shows a cross-sectional view of an interior portion of a housing and components enclosed in the housing according to one embodiment of the present invention; and FIG. 3 shows an exploded view of angled surfaces of a drive gear and a cord take-up wheel according to one embodiment of the present invention.

DETAILED DESCRIPTION OF THE PREFERRED EMBODIMENTS

Figure 1:
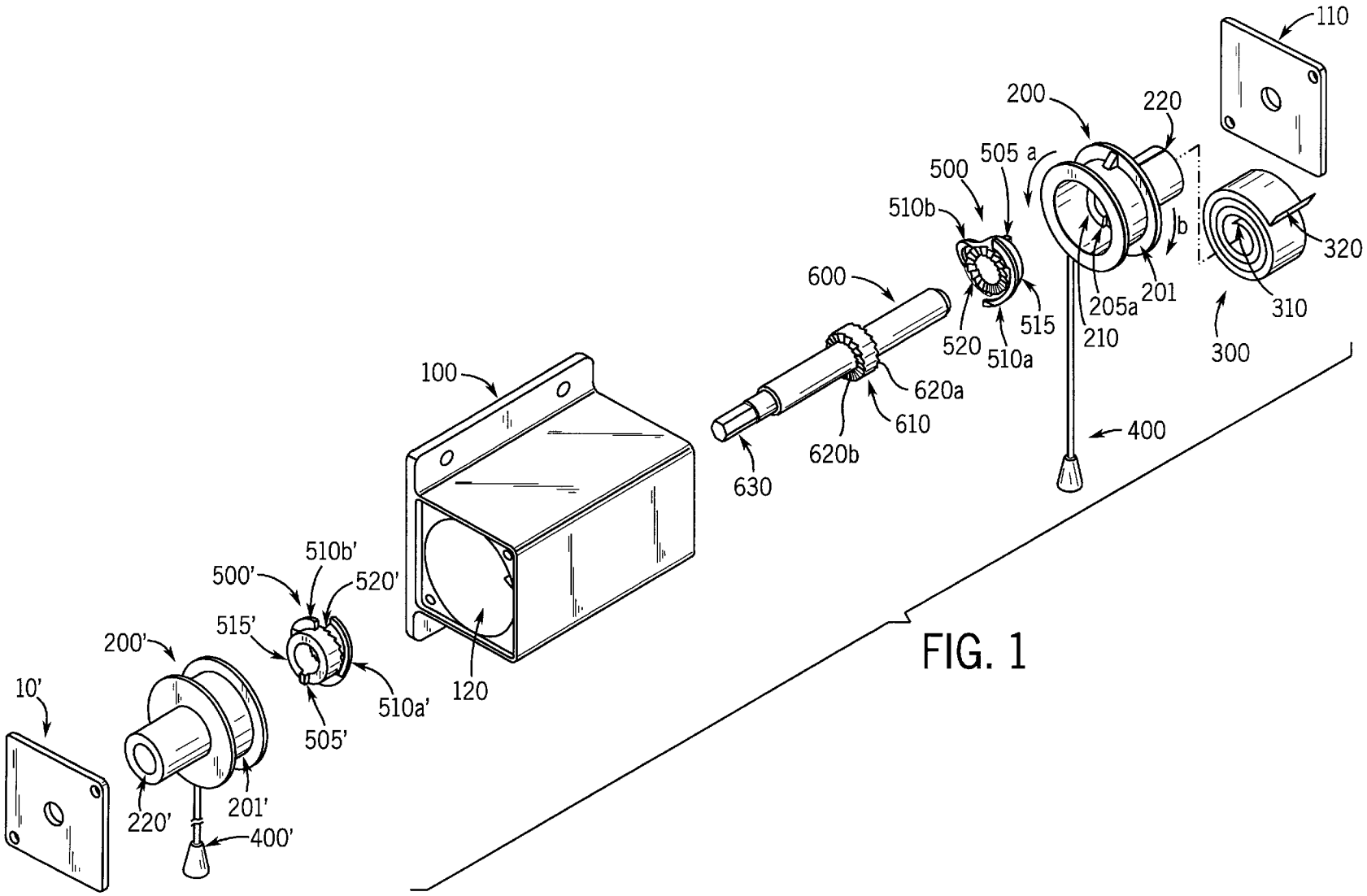
FIG. 1 illustrates a dual action retractable cord take-up reel according to one embodiment of the present invention.

According to one embodiment of the present invention, a dual action retractable cord take-up reel is provided for adjusting a position of a window covering. The retractable cord take-up reel can be attached to the hardware system of various types of window coverings to adjust a position of the window covering, for example, to raise, lower, or tilt the window covering. The position of the window covering is adjusted by pulling on one of two cords.

The retractable cord take-up reel is preferably arranged in two halves, one of which is substantially a mirror image of the other.

FIG. 1 illustrates a dual action retractable cord take-up reel for adjusting a position of a window covering according to one embodiment of the present invention. The retractable cord take-up reel comprises two cord take-up wheels 200, 200'. Each of the cord take-up wheels 200, 200' includes a reel portion 201, 201' for receiving a pull cord 400, 400'. A first cord 400 is wrapped around the reel portion 201 of the cord take-up wheel 200, and a second cord 400' is wrapped around the reel portion 201' of the cord take-up wheel 200'. Each of the cord take-up wheels 200, 200' also includes an internal cavity for receiving the respective drive gears 500, 500'. The internal cavity of the cord take-up wheel 200 includes a sloping or angled surface 210 that is intended to cooperate with an angled surface 515 on the drive gear 500. Similarly, the internal cavity of the cord take-up wheel 200' includes a sloping or angled surface (not shown) that is intended to cooperate with an angled surface 515' on the drive gear 500'.

Drive gears 500, 500' fit inside the internal cavities of the cord take-up wheels 200, 200', respectively. Each of the drive gears 500, 500' includes the previously mentioned angled surfaces 515, 515' on one side thereof, and teeth 520, 520' on an opposite side thereof.

The angled surfaces 515, 515' include cogs 505, 505' for coacting with steps on the angled surfaces of the cord take-up wheels 200, 200', respectively. In FIG. 1, only one step 205*a* is illustrated. However, there are preferably two steps on each of the angled surfaces of the cord take-up wheels 200, 200'

A drive shaft 600 is arranged through central openings in the drive gears 500, 500' and through the internal cavities and central openings in the cord take-up wheels 200, 200'. The drive shaft 600 includes an end 630 having flat surfaces to facilitate attachment to a window covering mechanism. Of course, this end 630 may, alternately, be some other shape or design suitable for attachment to a window covering mechanism in any other conventional manner.

The drive shaft 600 includes a gear 610 having teeth 620*a*, 620*b* facing the drive gears 500, 500', respectively. The teeth 620*a* on the drive shaft gear 610 match the teeth 520 on the drive gear 500, and the teeth 620*b* on the drive shaft gear 610 match the teeth 520' on the drive gear 500'.

The drive gears 500, 500' include, on respective surfaces facing the drive shaft 600, flippers 510*a*, 510*b* and 510*a'*, 510*b'*, respectively. These flippers bias the drive gears 500, 500' away from the drive gear 610 and toward the cord take-up wheels 200, 200', respectively, as described in more detail below.

Coupled to a side of the cord take-up wheel 200 opposite the side facing the drive shaft 600 is a spiral-shaped recoil spring 300. The recoil spring 300 includes an end 310 that is attached to the cord take-up wheel 200 through a slot 220 in the cord take-up wheel 200. The recoil spring 300 may alternately be attached to the cord take-up wheel 200 by other means, e.g., a pin or a snap. The recoil spring 300 includes another end 320 that is attached to an interior surface of the housing 100. The end 320 may, for example, fit into a groove in the housing. Alternately, the recoil spring 300 may be attached to the housing by means such as a screw. Although only one recoil spring 300 is shown, another spiral-shaped recoil spring is coupled in a similar manner to the side of cord take-up wheel 200' opposite the drive shaft 600 through a slot 220' on the cord take-up wheel 200'.

A housing 100 includes an internal cavity 120 for holding the drive shaft 600, the drive gears 500, 500', the cord take-up wheels 200, 200', and the recoil springs. End plates 110, 110' are mounted to respective ends of the housing. The housing 100 is preferably small in relation to the window covering so as to easily fit into a head rail and thus be unobtrusive. For example, the housing can be 1" square.

FIG. 2 shows a cross-sectional view of an interior portion of the housing 100 and components enclosed in the housing according to one embodiment of the present invention. For ease of illustration, only the drive shaft 600, the drive gear 610, and the drive gear 500 are shown enclosed by the housing 100.

In a central part of the cavity 120 is a partial wall 130 that includes an opening in a center thereof for receiving the drive shaft gear 610. The flippers 510*a*, 510*b*, 510*a'*, and 510*b'* are arranged so that the free end of each flipper rests against the partial wall 130 and biases the respective drive gear 500, 500' away from the drive shaft gear 610 and toward the respective cord take-up wheel 200, 200'.

The angled surface 515 of the drive gear 500 slopes upward toward the cord take-up wheel 200. This is shown in more detail in FIG. 3 which shows an exploded view of the angled surfaces of the drive gear 500 and the cord take-up wheel 200 according to one embodiment of the present invention.

Referring to FIG. 3, the angled surface 515 slopes upward toward the cord take-up wheel 200 at an angle of β degrees from the vertical. Similarly, the angled surface 210 of the cord take-up wheel 200 slopes downward toward the drive gear 500 at an angle of β degrees from the vertical. Thus, the angled surface 210 of the cord take-up wheel 200 "corresponds to" the angled surface 515 of the drive gear 500 in that both angled surfaces slope at the same angle from the vertical. In a preferred embodiment, the angle β is shallow, in the range of 3°–6°. It is not necessary for the angle of the surface 515 to equal the angle of the surface 210.

The angled surface 210 has a step 205*a* at a high portion and a step 205*b* at a low portion. These steps 205*a,b* coact with the cog 505 as described in more detail below.

Although not shown, the angled surface 515' slopes, in a similar manner, upward toward the cord take-up wheel 200', and an angled surface of the cord take-up wheel 200' slopes downward toward the drive gear 500', the angled surface 515' of the drive gear 500' corresponding to the angled surface of the cord take-up wheel 200'. Also, the angled surface of the cord take-up wheel 200' includes two steps that coact with the cog 505' in a similar manner as the steps 205*a,b* coact with the cog 505.

Referring again to FIG. 1, when the cord 400 is pulled, the cord take-up wheel 200 rotates in a first direction a. At this time, the flippers 510*a,b* urge the drive gear 500 away from engagement with the gear 610. Accordingly, the drive gear 500 does not rotate on the drive shaft 600 until the step 205*a* on the angled surface 210 of the cord take-up wheel 200 comes to rest against the cog 505. The step 205*a* is on a high location on the angled surface 210. Accordingly, when the cog 505 abuts the step 205*a*, the drive gear 500 is pushed into engagement with the gear 610. This causes the teeth 520 on the gear 500 to engage the teeth 620*a* on the drive shaft gear 610, causing the drive shaft 600 to rotate in the first direction a. In this manner, the force caused by pulling on the cord 400 is translated directly to the drive shaft 600, causing it to rotate in the first direction a.

When the cord 400 is released, it is then recoiled onto the cord take-up wheel 200, which is driven by the recoil spring 300 in a second direction b, opposite the first direction, to its original position. As the cord take-up wheel 200 turns in the second direction b, the drive gear 500 remains in place in engagement with the drive shaft gear 610 until a second step 205*b* comes to rest against the cog 505. The second step 205*b* is at a low location on the angled surface 210. Accordingly, at this time, the flippers 510*a,b* push against the wall 130 to disengage the drive gear 500 from the gear 610. This causes the drive gear teeth 520 to disengage from the drive shaft gear teeth 620*a*. Thus, while the cord 400 is being rewound onto the wheel 200, the drive shaft 600 is not rotated.

While the above described action occurs with respect to the wheel 200 and the drive gear 500, the flippers 510*a',b'* hold the drive gear 500' disengaged from the gear 610. Accordingly, the drive gear 500' and the cord take-up wheel 200' do not rotate with the drive shaft 600 and the drive shaft gear 610. In addition, the spring 300' helps in holding the cord take-up wheel 200' stationary during this process.

When the cord 400' wrapped around the reel portion 201' of the cord take-up wheel 200' is pulled, the teeth 520' of the drive gear 500' engage the teeth 620*b* of the drive shaft gear 610 in a manner similar to that described above. This causes the drive shaft 600 to turn in the second direction b that is opposite the first direction a. When the cord 400' is released, it is recoiled onto the cord take-up wheel 200', and the apparatus becomes disengaged in a manner similar to that described above.

As described above, the present invention provides a dual action retractable cord take-up reel for adjusting a position of a window covering without a cord loop.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A retractable take-up reel, comprising:

a drive shaft;

a first reel mounted on said drive shaft and having a central opening and a first side thereof;

a drive shaft gear mounted on said drive shaft, such that rotation of the drive shaft gear rotates said drive shaft;

a first drive gear mounted on said drive shaft between said first reel and said first drive shaft gear, said first drive gear having a central opening and a first side facing said first reel and a second side facing said drive shaft gear;

one of the first side of said first reel and the first side of said first drive gear having an angled surface, and the other of the first side of said first reel and the first side of said first drive gear having a cog facing the one first side; and the one first side having two steps thereon for engaging the cog, wherein a first one of the steps is at a low portion on the angled surface and a second one of the steps is at a high portion of the angled surface;

whereby when the cog is engaged with the first step said first drive gear is engaged with said drive shaft gear, and when the cog is engaged with the second step said first drive gear is not engaged with said drive shaft gear.

2. The retractable take-up reel of claim 1, further comprising a cord wound on said first reel, whereby when the cord is pulled, said first reel rotates so that the cog engages with the first step, and said drive shaft is driven in a first direction.

3. The retractable take-up reel of claim 1, further comprising means on said first drive gear for biasing the first drive gear out of engagement with said drive shaft gear.

4. The retractable take-up reel of claim 1, further comprising a second reel and a second drive gear, said second reel and said second drive gear being configured similar to said first reel and said first drive gear and being mounted on said drive shaft on an opposite side from said first reel and said first drive gear.

5. The retractable take-up reel of claim 2, further comprising a second reel and a second drive gear, said second reel and said second drive gear being configured similar to said first reel and said first drive gear and being mounted on said drive shaft on an opposite side from said first reel and said first drive gear, said second reel having a cord wound thereon so that when the cord on said second reel is pulled, said drive shaft is driven in a second direction that is opposite the first direction.

6. An apparatus for taking up a cord, comprising:

means for driving;

first means for winding a cord, said first winding means mounted on said driving means and having a central opening and a first side thereof;

means for rotating said driving means, said rotating means mounted on said driving means;

a first means for engaging said rotating means mounted on said driving means between said first winding means and said rotating means, said first engaging means having a central opening and a first side facing said first winding means and a second side facing said rotating means;

one of the first side of said first winding means and the first side of said first engaging means having an angled surface, and the other of the first side of said first winding means and the first side of said first engaging means having a cog facing the one first side; and the one first side having two steps thereon for engaging the cog, wherein a first one of the steps is at a low portion on the angled surface and a second one of the steps is at a high portion of the angled surface;

whereby when the cog is engaged with the first step, the first engaging means is engaged with said rotating means, and when the cog is engaged with the second step, said first engaging means is not engaged with the rotating means.

7. The apparatus of claim 6, wherein the cord is wound on said first winding means, such that when the cord is pulled, said first winding means rotates so that the cog engages with the first step, and said driving means is driven in a first direction.

8. The apparatus of claim 6, further comprising means on said first engaging means for biasing said first engaging means out of engagement with said rotating means.

9. The apparatus of claim 1, further comprising a second winding means and a second engaging means, said second winding means and said second engaging means being configured similar to said first winding means and said first engaging means and being mounted on said driving means on an opposite side from said first winding means and said first engaging means.

10. The apparatus of claim 7, further comprising a second winding means and a second engaging means, said second winding means and said second engaging means being configured similar to said first winding means and said first engaging means and being mounted on said driving means on an opposite side from said first winding means and said first engaging means, said second winding means having a cord wound thereon so that when the cord on said second winding means is pulled, said driving means is driven in a second direction that is opposite the first direction.

11. An apparatus for adjusting a position of a window covering, comprising:

a cord;

a cord take-up wheel having a reel portion for receiving the cord;

a drive gear adjacent to the cord take-up wheel, a surface of the cord take-up wheel having an angle which corresponds to an angle of a surface of the drive gear facing the cord take-up wheel; and a drive shaft adapted to be coupled to the window covering and arranged through a central opening in the drive gear and a central opening in the cord take-up wheel, the drive shaft including a gear for engaging with the drive gear, wherein a pulling action on the cord causes the drive gear to meet the drive shaft gear, causing the drive shaft to rotate in one direction, thus causing the window covering to move in that direction.

12. The apparatus of claim 11, further comprising:

another cord take-up wheel having another reel portion for receiving another cord;

another drive gear adjacent to the other cord take-up wheel, a surface of the other take-up wheel having an angle which corresponds to an angle of a surface of the other drive gear facing the other cord take-up wheel, wherein the drive shaft is arranged through a central opening in the other drive gear and a central opening in the other cord take-up wheel, the drive shaft gear matching the other drive gear, wherein a pulling action on the other cord causes the other drive gear to meet the drive shaft gear, causing the drive shaft to rotate in another direction, thus causing the window covering to move in the other direction.

13. The apparatus of claim 12, further comprising:

recoil springs coupled to sides of the cord take-up wheels that are opposite the drive shaft, wherein the recoil springs recoil the cords onto the cord take-up wheels when the pulling action on the cords are discontinued.

14. The apparatus of claim 12, wherein the other direction is opposite from the one direction.

15. The apparatus of claim 12, wherein the drive gears further comprise means for biasing the drive gears away from the drive shaft gear.

16. An apparatus for adjusting a position of a window covering comprising:

a cord;

means for receiving the cord;

means, attached to a window covering and arranged through a central opening in the receiving means, for moving the window covering;

means for translating motion from the receiving means to the moving means, a surface of the receiving means having an angle which corresponds to an angle of a surface of the translating means facing the receiving means, wherein a pulling action on the cord causes the receiving means to rotate in one direction, and the translating means translates the rotating motion to the moving means, thus causing the window covering to move in that directions;

other means for receiving another cord, wherein the moving means is arranged through a central opening in the other receiving means;

other means for translating motion from the other receiving means to the moving means, a surface of the other receiving means having an angle which corresponds to an angle of a surface of the other translating means facing the other receiving means, wherein a pulling action on the other cord causes the other receiving means to rotate in another direction, and the other translating means translates the rotating motion to the moving means, thus causing the window covering to move in the other direction; and means, coupled to sides of the receiving means that are opposite the moving means, for recoiling the cords, wherein the recoiling means recoil the cords onto the respective receiving means when the pulling actions on the cords are discontinued.

17. The apparatus of claim 16, wherein the other direction is opposite from the one direction.

18. The apparatus of claim 16, wherein each translating means further comprises means for biasing each translating means toward the respective receiving means.

19. An apparatus for adjusting a position of a retractable covering, comprising:

a cord having a first and second end;

a retractable cord take-up wheel for receiving the cord, the first end of the cord attached to the take-up wheel;

a spring for recoiling the take-up wheel;

a drive shaft releasably engaged to the take-up wheel, the drive shaft adapted to be coupled to the covering;

a coupling device for releasably engaging the take-up wheel to the drive shaft such that pulling the second end of the cord away from the take-up wheel engages the drive shaft to retract the covering, and release of the cord disengages the drive shaft from the take-up wheel and automatically recoils the cord onto the take-up wheel.

20. The apparatus of claim 19, further including a second take-up wheel, and a second cord having a first end and a second end, the first end of the second cord being attached to the second cord-take up wheel, a second recoil for recoiling the second take-up wheel;

the drive shaft being releasably engaged to the second cord take up wheel;

a second coupling device for releasably engaging the second take-up wheel to the drive shaft such that pulling the second end of the second cord away from the second take-up wheel engages the drive shaft to extend the covering, and release of the second cord disengages the drive shaft from the second take-up wheel and automatically recoils the second cord onto the second take-up wheel.

* * * * *